US007434809B2

(12) United States Patent
Silverman

(10) Patent No.: US 7,434,809 B2
(45) Date of Patent: Oct. 14, 2008

(54) METHOD AND APPARATUS FOR PLAYING BLACKJACK WITH ACTIVE WORKING WAGERS

(75) Inventor: Bruce D. Silverman, Minneapolis, MN (US)

(73) Assignee: Applied Gaming Dynamics, LLC, Edina, MN (US)

( * ) Notice: Subject to any disclaimer, the term of this patent is extended or adjusted under 35 U.S.C. 154(b) by 472 days.

(21) Appl. No.: 11/332,008

(22) Filed: Jan. 13, 2006

(65) Prior Publication Data

US 2006/0151954 A1 Jul. 13, 2006

Related U.S. Application Data

(60) Provisional application No. 60/643,520, filed on Jan. 13, 2005.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

D263,975 S * 4/1982 Quiroga et al. ..... D21/369
5,308,081 A * 5/1994 Bartle ..... 273/274
5,806,847 A * 9/1998 White et al. ..... 273/309
5,836,586 A 11/1998 Marks et al.
6,113,102 A 9/2000 Marks et al.
6,273,424 B1 * 8/2001 Breeding ..... 273/292
6,454,266 B1 * 9/2002 Breeding et al. ..... 273/292
6,520,503 B1 * 2/2003 Porto ..... 273/274
6,679,497 B2 1/2004 Walker et al.
6,969,316 B2 11/2005 Jarvis et al.
7,246,799 B2 * 7/2007 Snow ..... 273/292
7,367,563 B2 * 5/2008 Yoseloff et al. ..... 273/292
2002/0027322 A1 * 3/2002 Breeding et al. ..... 273/292
2002/0119815 A1 * 8/2002 Lyons ..... 463/16
2007/0284820 A1 * 12/2007 Centrone ..... 273/292

* cited by examiner

*Primary Examiner*—Gene Kim
*Assistant Examiner*—Dolores Collins
(74) *Attorney, Agent, or Firm*—Merchant & Gould P.C.

(57) ABSTRACT

A variation of the card game of Blackjack that offers predetermined side wagers. The side wagers include wagering options for or against the dealer forming a final hand value of 17, 18, 19, 20, 21 or blackjack before the dealer forms a final hand value that exceeds 21 (also known as a bust); for or against the dealer forming a final hand value of 17, 18, 19, 20 or bust before the dealer forms any natural two-card blackjack or any combination of three or more cards totaling 21; for or against the dealer forming any natural two-card blackjack before forming any combination of three or more cards totaling 21; and other side bet scenarios that offer the player sustainable wagering opportunities where the outcome of any side bet is not necessarily decided on any one given hand of play.

19 Claims, 13 Drawing Sheets

METHOD AND APPARATUS FOR PLAYING BLACKJACK WITH ACTIVE WORKING WAGERS

RELATED APPLICATIONS

This application claims priority to U.S. Provisional Patent Application No. 60/643,520, entitled "Method and Apparatus for Playing Blackjack with Multiple Wagering Options" filed Jan. 13, 2005, which is hereby incorporated by reference.

FIELD OF THE INVENTION

This application relates generally to a method and apparatus for playing a card game; more particularly to a method and apparatus for playing a modified version of the card game Twenty-one (also known as "21" or "Blackjack") in which working wagers may be made that are active until a specific losing event occurs; and more particularly still to a method and apparatus for playing Blackjack in which a player may make working wagers which remain active until either a losing event occurs or the player requests that the working wager be removed/discontinued.

BACKGROUND OF THE INVENTION

The game of Blackjack is one of the most popular casino table games. It offers fast action and a relatively low house advantage for players as well as dependable income for the casino. However, the proliferation of casinos has created increased competition and a need for new games that generate interest and participation among casino patrons. As a result, casinos are constantly exploring new variations of blackjack with various side bets intended to increase the amounts wagered (sometimes referred to as increasing the player "action"). The casinos also try to retain the overall advantage in order to generate incremental income.

Many of these Blackjack games involve side bets based on the total or partial value of the dealer's hand, including side bets based on the final outcome of the dealer's hand. For example, U.S. Pat. No. 6,113,102 to Marks et al. discloses wagers on whether the value of the cards making up the dealer's hand will have a final value of 17, 18, 19, 20, 21, an initial two card value of 21 or a bust on any given hand. Other prior art side bets are based on whether one or both of the dealer's initial two cards will have a certain value. However, the drawbacks associated with these side bets are that the player is offered the prospect of long odds and limited options. Moreover, these side bets are essentially one-hand bets—i.e., where the player either wins or loses the side bet based on the outcome of a single hand played. These inherent limitations involving blackjack side bets generally create limited interest from casino operators, as either the odds of winning these side bets are too long for casino patrons to play on a continual basis or there is simply a lack of interest generated by the underlying concept behind the side bet.

In view of the foregoing, there is a need in the art for an apparatus and method for playing a blackjack game that offers sustainable side bets that enhance the player's experience and bring new dimension to the underlying blackjack game. More particularly, there is a need in the art for working wagers that remain active over several hands of play.

BRIEF SUMMARY OF THE INVENTION

The present invention introduces the concept of "working wagers" or "working bets" to the game of Blackjack. A "working wager/bet" is defined as a bet that is "live" or active until either a specific losing event occurs or the player asks that the bet be discontinued. Such bets have the potential to pay off numerous times and ensure that the player does not lose the bet unless a specific losing event occurs. Much like the "place number" bets in the game of Craps (e.g., a bet where a player can wager that certain dice values will occur before the dice value of seven occurs and vice versa), the present invention offers Blackjack players the same style of action by providing an optional wager that the value of the cards making up certain final dealer hands occur before other final dealer hand outcomes. Given that the dealer is subject to fixed rules of play and that there are fixed probabilities for the seven possible final dealer hand outcomes 17, 18, 19, 20, 21, blackjack and busting (exceeding 21), various and unique active side bets can be offered.

The present invention creates and provides for a number of working wagers on whether certain events will occur prior to other certain events. Such wagers bring numerous features and benefits to the game of Blackjack. Examples include:

- Providing a player with sustainable hedging opportunities where the player can place side bets on the likelihood of any given dealer hand outcome occurring to offset the likelihood of the dealer having a winning hand.
- Providing a player with the opportunity to create playing strategies that can influence decision making for the underlying Blackjack game.
- Providing a player with numerous wagering options that can be made independent of the decision making process for the underlying Blackjack game.
- Providing the opportunity for a player to engage in wagering on the outcome of the dealer's hand with or without participating in the underlying Blackjack game.
- Providing the casino with an opportunity for incremental income without requiring additional space, tables or game surveillance.

Working wagers in accordance with the invention can be played with one or more standard 52-card-decks without appreciably changing the odds or payout schedules of the side bets disclosed herein. Further, the working wagers can be utilized in games where the dealer either stands or hits on a soft 17—without appreciably changing the odds or payout schedules of the side bets. Still further, the normal card sequence and rules of the underlying Blackjack game are not appreciably altered.

The present invention can be adapted to various gaming formats and media platforms in addition to utilizing standard Blackjack tables, including single-player and multi-player video slot machines, electronic games and devices, lottery terminals, lottery scratch-off cards, home-entertainment software, online gaming applications and online non-gaming applications.

Therefore, according to one aspect of the invention, there is provided a method of playing the card game Blackjack, the Blackjack game of the type including a dealer and at least one player, comprising: placing wagers prior to a first hand of play that at least one of one or more predetermined final dealer hand values will occur before one of one or more different designated final dealer hand values, wherein the sum of the probabilities for the predetermined winning and losing final dealer hand values for any given hand of play is less than the total probability for all possible final dealer hand values during any given hand of play; dealing cards to the dealer and the player for the first hand of play; and determining if the wager is satisfied, wherein: the placed wager is won by the player only when a predetermined winning final dealer hand value occurs during the first hand of play; the placed wager is lost by the player only when a predetermined losing final dealer hand value occurs during the first hand of play; and the placed wager is neither won or lost if neither a predetermined winning or losing final dealer hand value occurs during the first hand of play.

According to another aspect of the invention, there is provided a method of playing the card game Blackjack in accordance with the preceding paragraph, and further comprising: allowing the player to remove or maintain the placed wager prior to a second hand of play; and dealing cards and determining if the placed wager is satisfied.

According to yet another aspect of the invention, there is provided a method of playing the card game Blackjack, according to the preceding paragraphs, and further comprising: allowing the player to place additional wagers prior to a second hand of play; and dealing cards and determining if the placed wager and placed additional wager is satisfied.

While the invention will be described with respect to preferred embodiment configurations, particular groups of working wagers, and recommended payouts, it will be understood that the invention is not to be construed as limited in any manner by either such configuration, working wagers or recommended payouts described herein. Also, while the particular Blackjack table layouts are described herein, it will be understood that such particular layouts are not to be construed in a limiting manner. Instead, the principles of this invention extend to a Blackjack game in which players may make active working wagers. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

BRIEF DESCRIPTION OF THE DRAWINGS

The present invention will be described in detail with reference to the following drawings. It is to be understood that the invention is not limited to the configurations represented by the following drawings and that the various embodiments of the invention can be configured in other manners in view of the present disclosure.

DETAILED DESCRIPTION OF THE INVENTION

Figure 1:
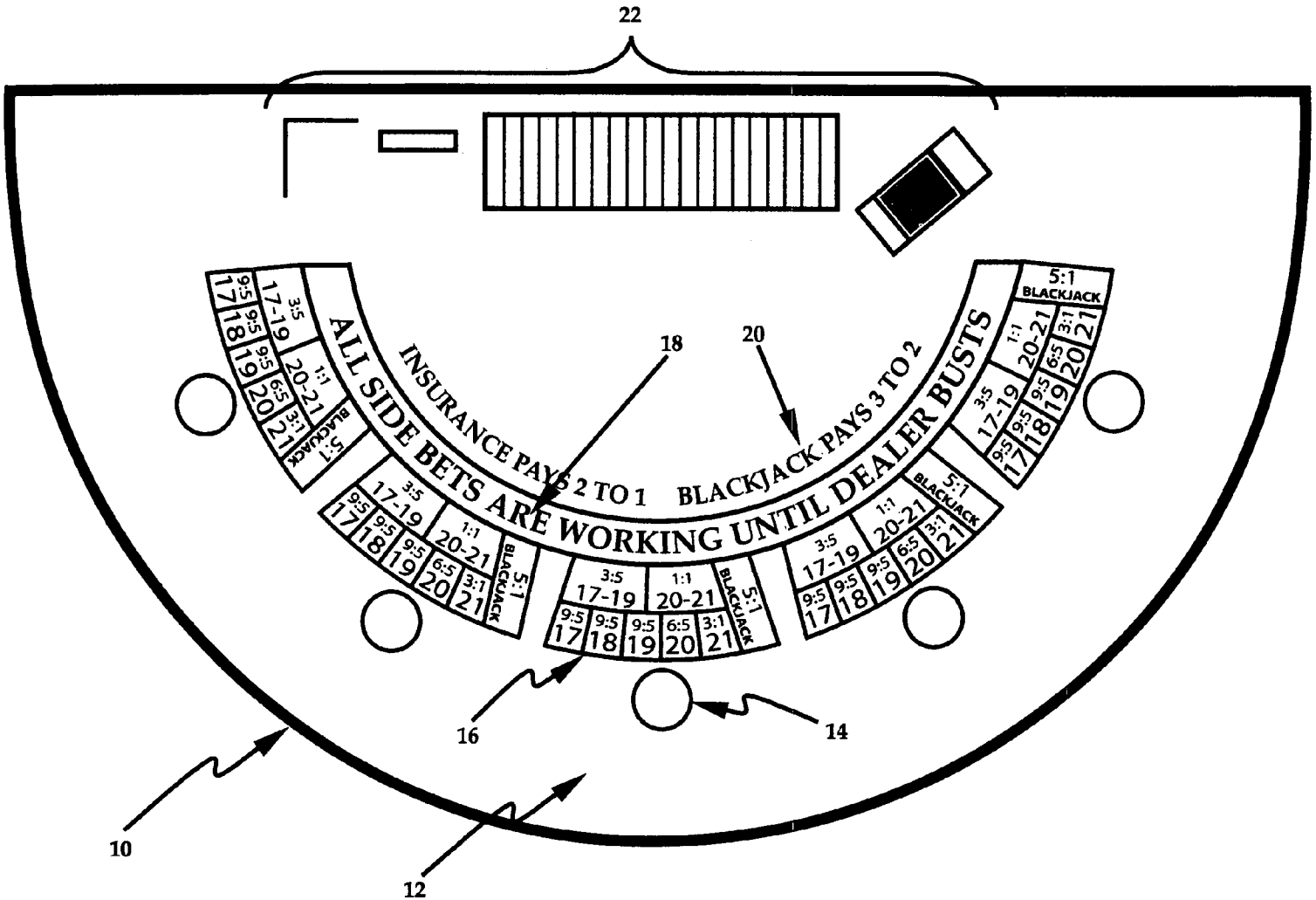
FIG. 1 is an illustration of a playing surface for an embodiment in accordance with the invention that provides wagering options based on the probabilities of the dealer having cards with values totaling one of one or more of the final hand values 17, 18, 19, 20, 21 or blackjack before the dealer busts.

An underlying principle of the present invention is based on the mathematics governing the probability of one of one or more given events occurring before one of one or more different events within a greater, finite set of events. Given that the dealer is subject to certain guidelines of standard Blackjack play, one of seven final dealer hand outcomes will always result if at least one player does not bust. These final dealer hand outcomes are: 17, 18, 19, 20, 21, blackjack or bust. It is noted that in the standard game of Blackjack that if all players bust prior to the dealer's turn, then the dealer will win the basic Blackjack bet having the value of the combination of two cards that were initially dealt to the dealer. This situation is described in more detail below.

Furthermore, since the rules of standard Blackjack play dictate that the dealer is subject to these events, set probabilities of occurrence may be determined. The present invention utilizes these probabilities of occurrence to construct wagering propositions that provide sustainable hedging strategies and other bets where the risk of losing the side bet is confined to a limited number of outcomes.

It will be appreciated by those of skill in the art that the basic game of Blackjack is well known. Accordingly, a description of the rules and manner of playing Blackjack are not set forth explicitly herein. However, for those wishing to review a general overview of the manner of play, reference may be had to U.S. Pat. No. 6,969,316, Returning now to an overview of the principles of the present invention, assume that the dealer is on a winning streak. The present invention allows for the player to make a side bet that hedges against the likelihood of the dealer forming a final hand value of twenty or twenty-one (e.g., which are very often winning hands for the dealer). However, instead of a one-hand bet, one wager provided under the principles of the present invention structures a wager in a way that limits the risk of losing.

In one betting scenario specific to the invention, the player can bet that the dealer will form a final hand value of twenty or twenty-one before the dealer busts. By confining the winning and losing outcomes to a subset of all possible outcomes, the player is allowed to mitigate risk to a small number of events. In this particular scenario, each time the dealer forms a final hand value of either twenty or twenty-one before the dealer busts, the player receives the corresponding payout for the side bet, regardless of whether he wins or loses the underlying game against the dealer's hand. However, the player will lose the side bet if the dealer busts. If the dealer neither busts nor forms a final hand value of twenty or twenty-one, the player's side bet remains untouched and the player can decide to either leave the side bet "working" for the next hand of play or withdraw the bet. The invention refers to the term "working" bet as a bet that remains live until either a losing outcome occurs or the player decides to discontinue the bet.

Conversely, if the dealer is on a losing streak, a reverse betting scenario allows the player to bet that the dealer will bust before forming a final hand value of either twenty or twenty-one. In this particular scenario, each time the dealer busts before forming a final hand value of either twenty or twenty-one, the player would win and the player would only lose the side bet if the dealer forms a final hand value of either twenty or twenty-one.

While a more detailed discussion of the various wagers is presented below, examples of the wagers include the following: for or against the dealer forming a final hand value of 17, 18, 19, 20, 21 or blackjack before the dealer forms a final hand value that exceeds 21 (also known as a bust); for or against the dealer forming a final hand value of 17, 18, 19, 20 or bust before the dealer forms any natural two-card blackjack or any combination of three or more cards totaling 21; for or against the dealer forming any natural two-card blackjack before forming any combination of three or more cards totaling 21; and other side bet scenarios that offer the player sustainable wagering opportunities where the outcome of any side bet is not necessarily decided on any one given hand of play.

In reference to FIGS. 1-10, the various embodiments of the invention can be played on a casino-style Blackjack table with a playing surface 10 that accommodates a plurality of one or more player positions 12, a primary betting area 14 for each player to bet on the underlying Blackjack game against the dealer's hand, an additional betting area 16 for each player to place side bets as they apply to the specific embodiments of the invention, inscribed guidelines of play as they relate to the specific embodiments of the invention 18, inscribed guidelines of play as they relate to the underlying Blackjack game 20, and a traditional Blackjack dealer station 22.

The dealer station 22 conforms to the typical needs of a Blackjack dealer to conduct a traditional game of Blackjack and includes a card dispensing device typically referred to as a shoe, a rack for holding chips, a drop slot for depositing player money and a device for collecting cards after each hand is played. The additional player betting area 16 includes one or more spaces with inscriptions to indicate the various wagers and corresponding payouts as they pertain to the specific embodiments of the invention.

Figure 11:
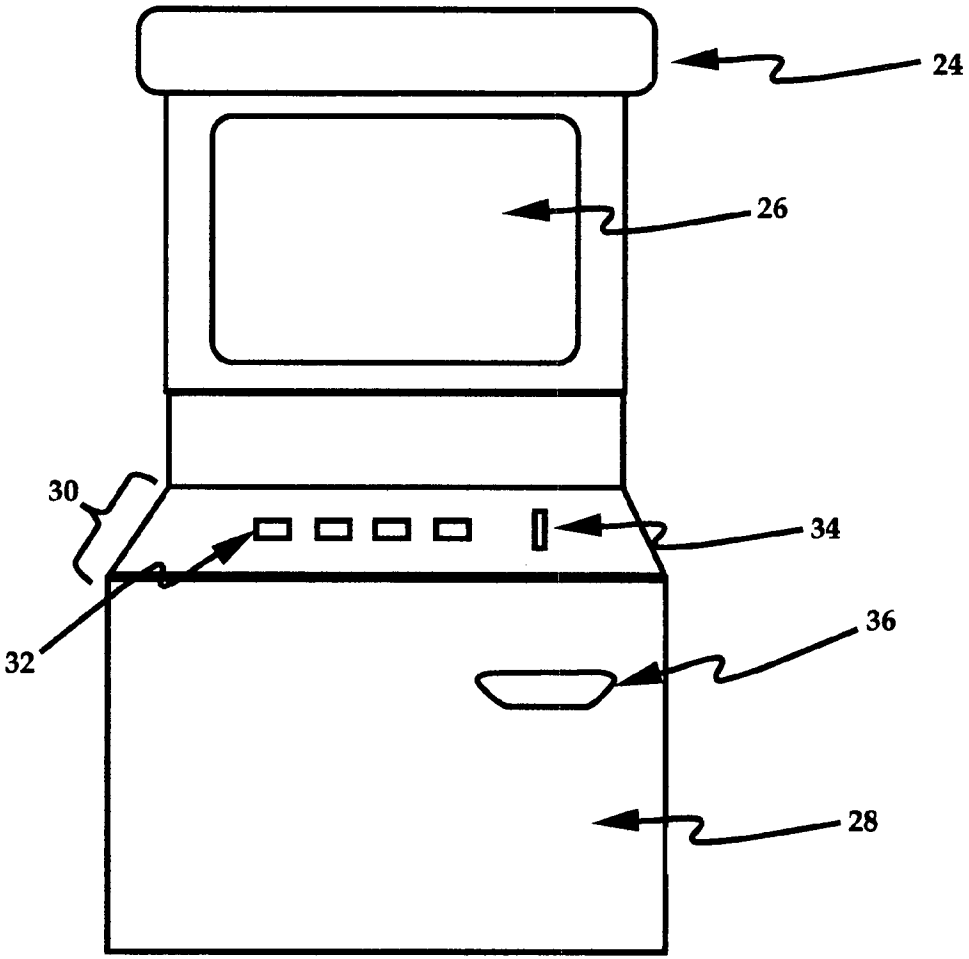
FIG. 11 is a schematic illustration of a video gaming machine apparatus of the type on which the various embodiments of the present invention may be played.
Figure 12:
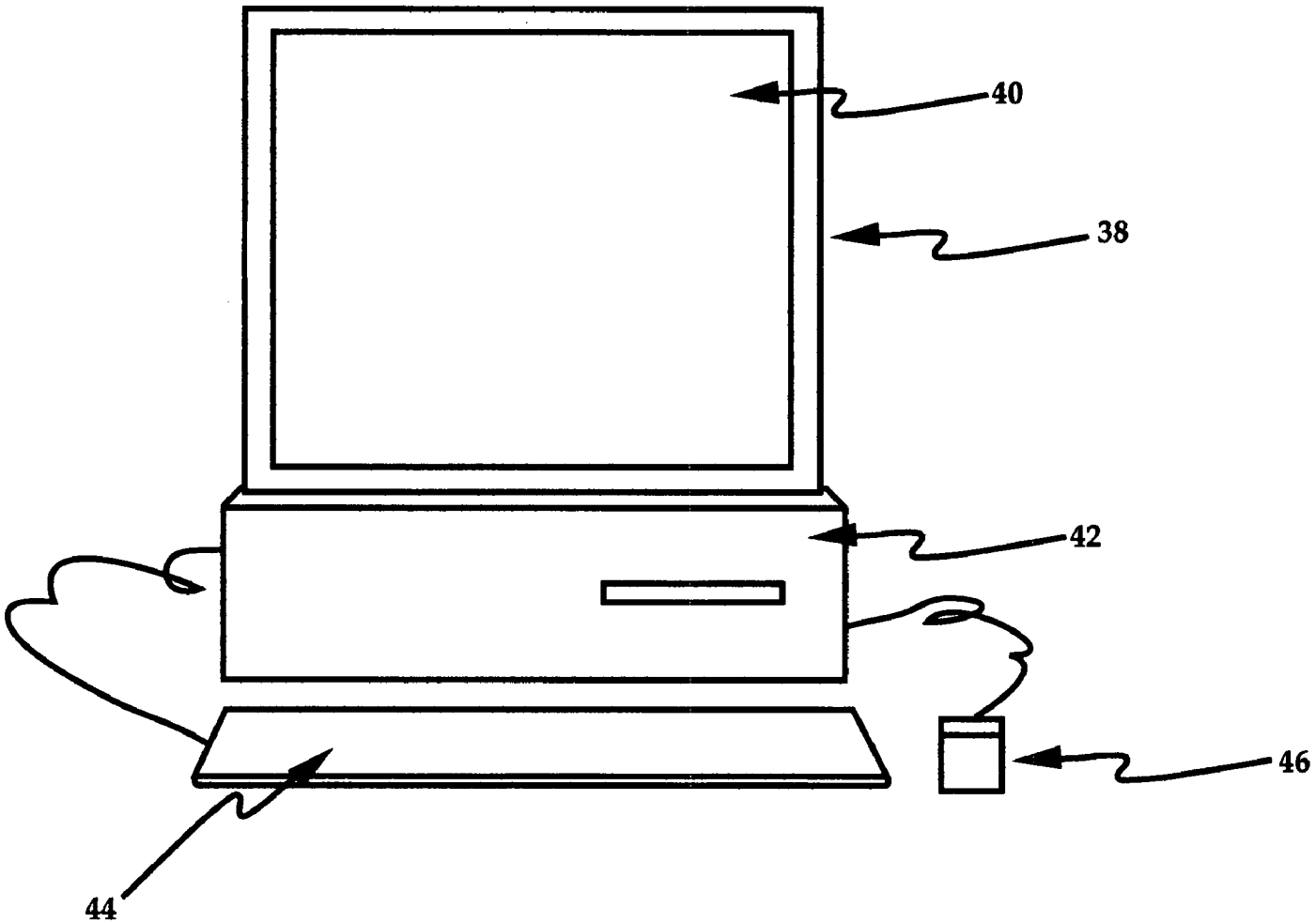
FIG. 12 is a schematic illustration of a personal computer apparatus of the type on which the various embodiments of the present invention may be played.

Additionally, the various embodiments of the invention may be played in a virtual environment. FIG. 11 is an illustration of a casino-style video gaming machine apparatus on which the various embodiments of the invention can be played and typically includes a physical housing 24, an electronic display monitor 26, a computer processor and computer program designed to conduct the game through random number generation technology 28, a player interface console 30 that includes buttons of some sort by which the player can input decisions for the game 32, an input device for depositing funds via coins, paper currency bank cards or casino debit cards 34 and an output device for returning sums to the player 36. FIG. 12 is an illustration of a personal computer apparatus on which the various embodiments of the invention can be played off-line or online over the internet at virtual casinos and typically includes a physical housing 38, an electronic display monitor 40, a computer processor and computer program designed to conduct the game through random number generation technology or via the internet at an online virtual casino 42, and a computer keyboard 44 and mouse device 46 to assist in play of the game.

Figure 13:
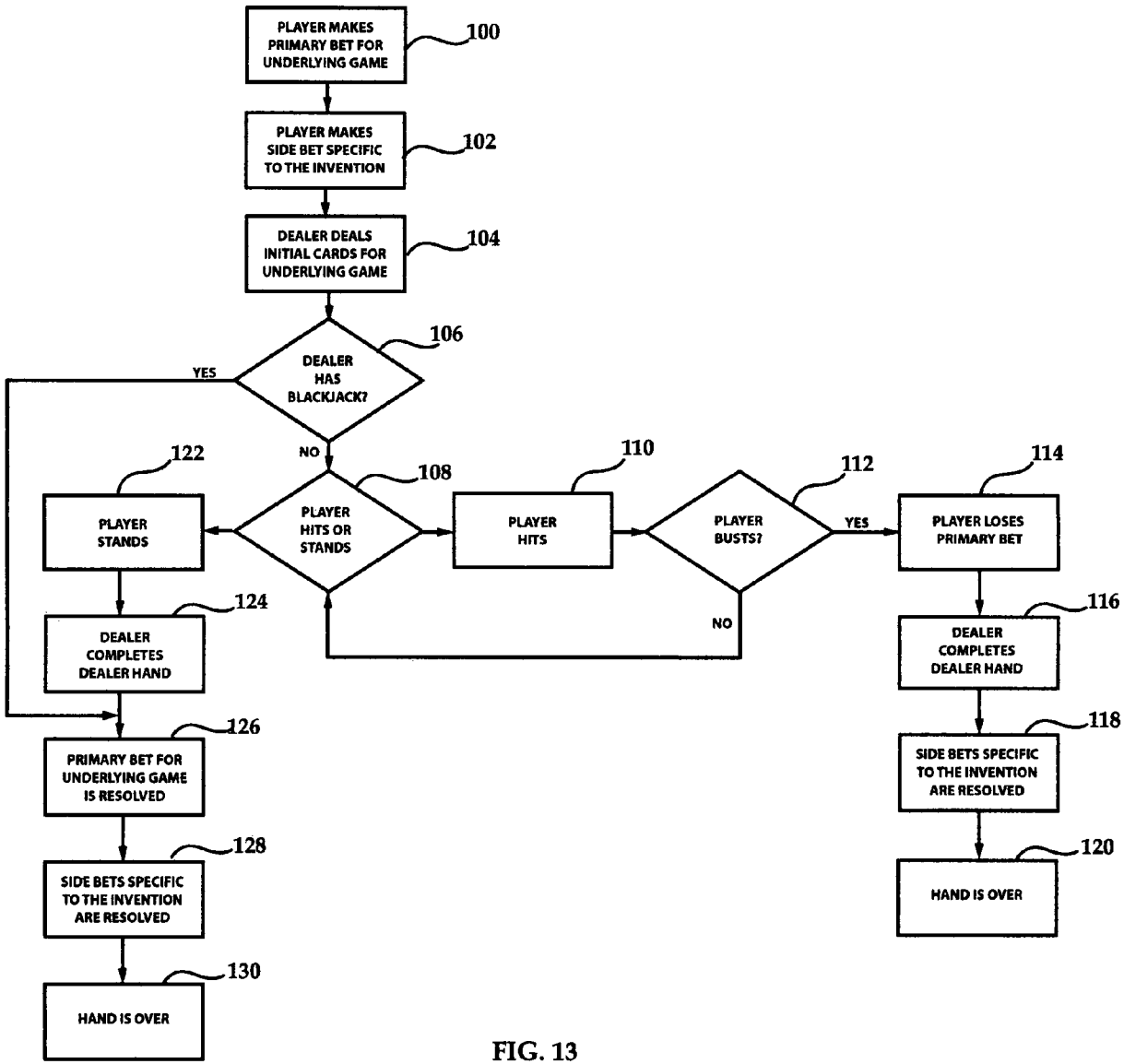
FIG. 13 is a flow chart of a game method according to an embodiment of the present invention.

FIG. 13 illustrates a flow chart of a game method according to an embodiment of the present invention and represents a typical scenario of how the game can be sequentially conducted. In the preferred embodiments of the invention, each player must place a wager for the underlying blackjack game in order to place additional bets as they relate to the various embodiments of the invention. However, optionally, players may make working wagers without participating in the underlying Blackjack game, with it anticipated that the game operators may initially decide whether a player must make a wager on the underlying Blackjack game in order to place bets as they relate to the various embodiments of the invention.

To begin the game, the player places a primary wager for the underlying Blackjack game against the dealer's hand at step 100 (if required) and optional side bet wagers as they relate to the various working wagers at step 102. Once all wagers have been placed, the dealer then proceeds to deal a hand of Blackjack in accordance with the traditional rules of Blackjack well-known to those skilled in the art at step 104. Here each player and the dealer receives two initial cards in rotation with players receiving both cards face-up and the dealer receiving one card face-up and one card face-down. It should be noted that the various embodiments of the invention are not affected by slight variations in rules or procedure for dealing the initial cards.

Once the initial cards have been dealt, it is determined whether the dealer has a natural blackjack at step 106. If the dealer has a natural blackjack, then the game jumps to step 126 where the primary bet for the underlying game is resolved. In this particular situation, at step 126 the player either ties with a blackjack or loses the primary bet for the underlying game. The side bets specific to the invention are then resolved at step 128 where the dealer compares his final hand value to any and all side bets placed in the additional betting area. If the dealer's final hand value matches a player's side bet in the player's favor, the dealer pays off the player's side bet accordingly. If the dealer's final hand value matches a player's side bet in the dealer's favor, the player loses the side bet. If the dealer's final hand value does not match a player's side bet in either the player's or the dealer's favor, the player's side bet is left untouched. After the side bets specific to the invention are resolved, the hand is over at step 130.

Returning to step 106, if the dealer does not have a natural blackjack, the player has the choice to either hit or stand at step 108. It is to be understood that the term "hit" means the player decides to take another card and the term "stand" means the player decides to take no additional cards. If the player decides to take an additional card at step 110, it is then determined if the additional card causes the player to bust at step 112. If the additional card does not cause the player to bust, then the game loops back to step 108 where the player once again has the choice to hit or stand. If at step 112 the additional card does cause the player to bust, then the player loses the primary bet for the underlying game at step 114. The dealer then completes his own hand at step 116, even if every player at the table busts and loses their primary bets at step 114. This is done so that the dealer's hand subscribes to one of the seven final dealer hand values of 17, 18, 19, 20, 21, blackjack or bust.

The side bets specific to the invention are then resolved at step 118 where the dealer compares cumulative total of the cards in the dealer's final hand to any and all side bets placed in the additional betting area. If the dealer's final hand value matches a player's side bet in the player's favor, the dealer pays off the player's side bet accordingly. If the dealer's final hand value matches a player's side bet in the dealer's favor, the player loses the side bet. If the dealer's final hand value does not match a player's side bet in either the player's or the dealer's favor, the player's side bet is left untouched. After the side bets specific to the invention are resolved at step 118, the hand is over at step 120.

Returning to step 108 where the player has the choice to hit or stand, if the player decides to stand at step 122, the dealer then completes his hand at step 124 according to the traditional rules of Blackjack. The player's primary bet for the underlying game against the dealer's hand is then resolved at step 126. After all primary bets have been resolved, the side bets specific to the invention are then resolved at step 128 where the dealer compares the dealer's final hand value to any and all side bets placed in the additional betting area. If the dealer's final hand value matches a player's side bet in the player's favor, the dealer pays off the player's side bet accordingly. If the dealer's final hand value matches a player's side bet in the dealer's favor, the player loses the side bet. If the dealer's final hand value does not match a player's side bet in either the player's or the dealer's favor, the player's side bet is left untouched. After the side bets specific to the invention are resolved at step 128, the hand is over at step 130.

SAMPLE EMBODIMENTS OF THE INVENTION

The following embodiments of the invention are illustrative of the flexibility and versatility of the underlying principle of the invention. Additional embodiments of the invention are explored in numeric format in the Additional Working Wager Embodiments and Payout Schedules.

Figure 2:
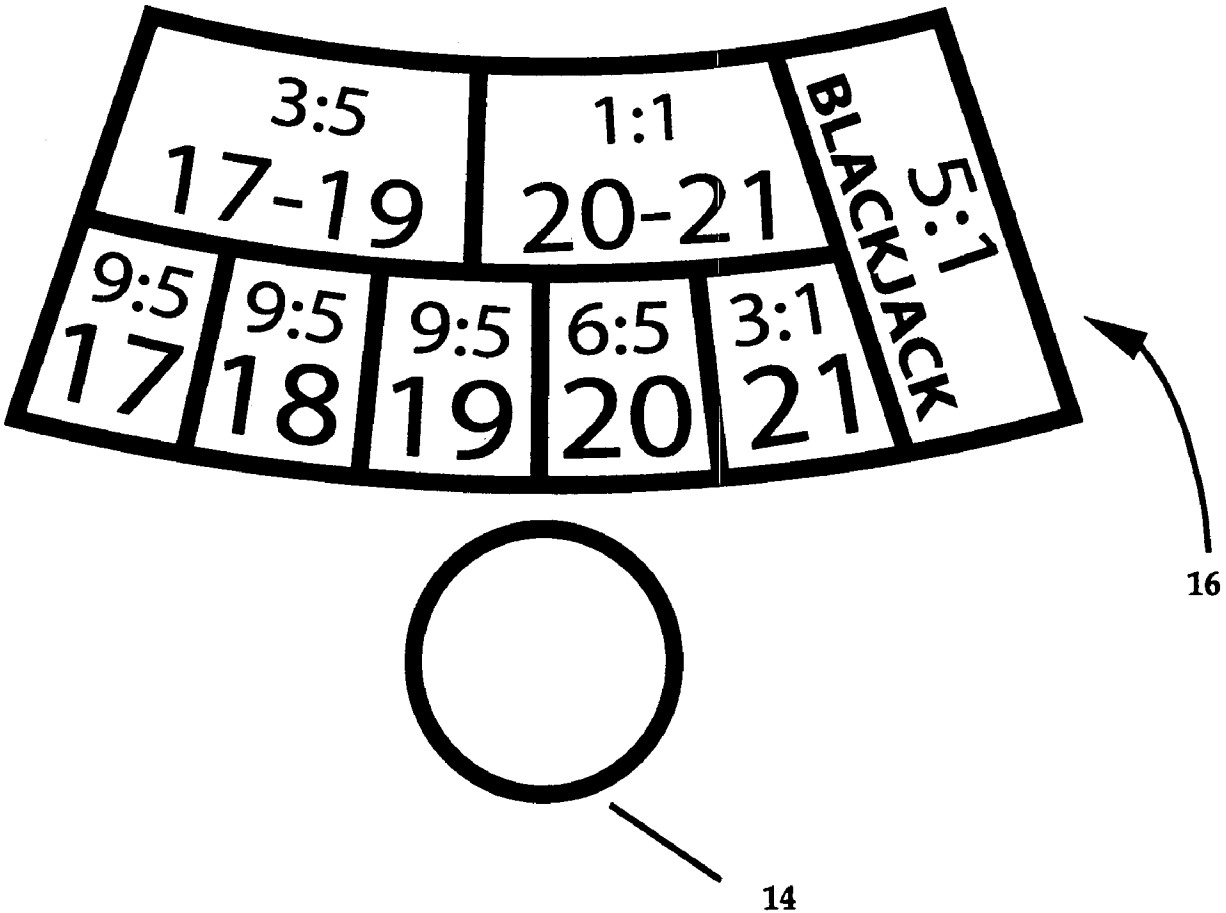
FIG. 2 is an enlarged illustration of the player betting area for the embodiment of FIG. 1.

FIG. 1 represents an embodiment of the invention that provides the player with side bet options based on the probabilities of the dealer forming one of one or more of the final hand values 17, 18, 19, 20, 21 or blackjack before the dealer busts. FIG. 2 is an enlarged illustration of the additional betting area 16 for the embodiment illustrated in FIG. 1. In this example, the player has the option of placing individual bets that the dealer will form a final hand value of 17 before the dealer busts, 18 before the dealer busts, 19 before the dealer busts, 20 before the dealer busts, 21 before the dealer busts or blackjack before the dealer busts. This example also offers the player the option of placing a single bet that the dealer will form either a 17, 18 or 19 before the dealer busts as well as a single bet that the dealer will form either a 20 or 21 before the dealer busts. A listing of wagering options, their associated true odds, possible payouts and house edges for the embodiment of the invention as illustrated in FIGS. 1 and 2 are enumerated in Table 1 set forth below.

Figure 3:
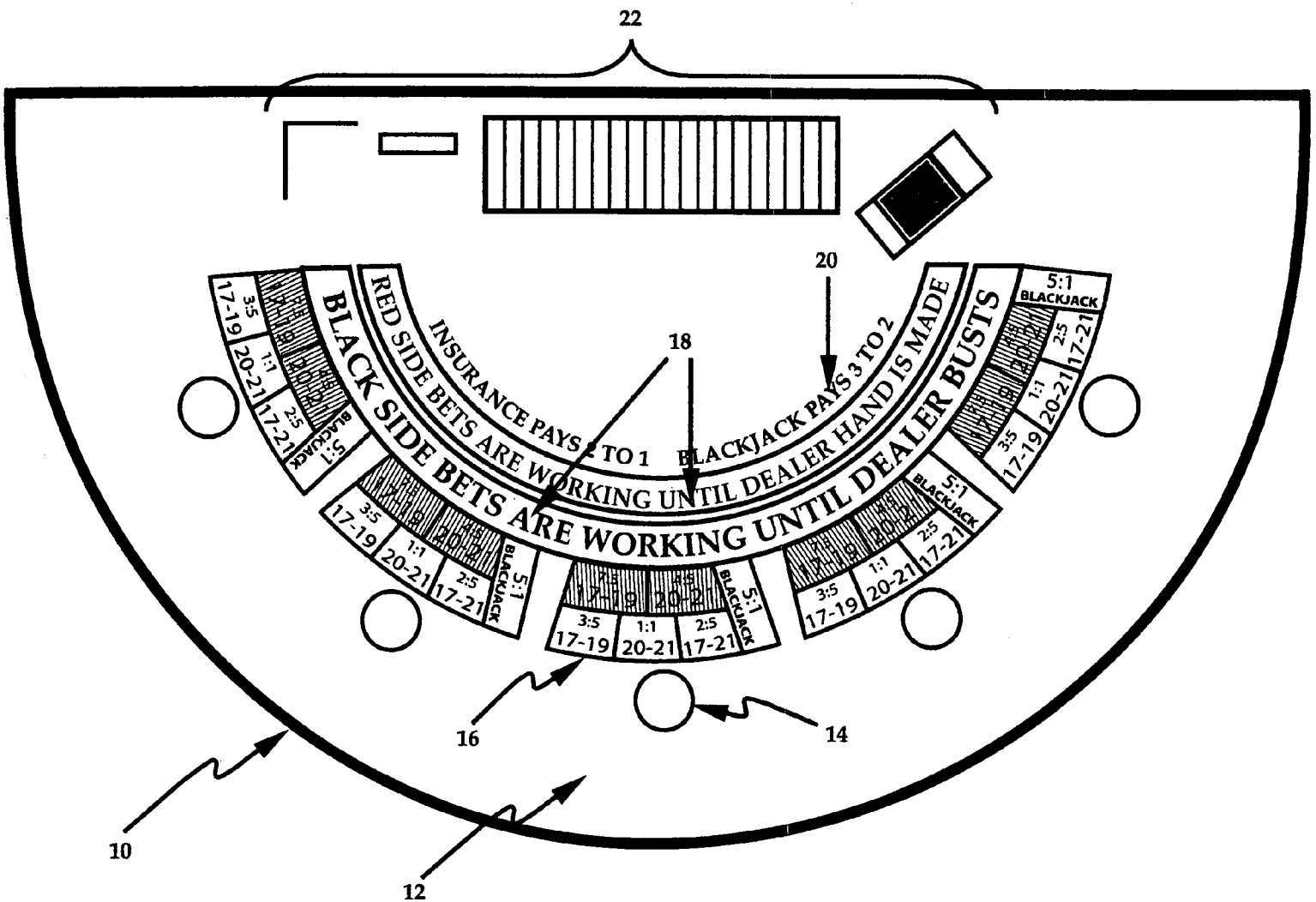
FIG. 3 is an illustration of a playing surface for an embodiment in accordance with the invention that provides wagering options based on the probabilities of the dealer having cards with values totaling one of one or more of the final hand values 17, 18, 19, 20, 21 or blackjack before the dealer busts, as well as the reverse wagering options based on the probabilities of the dealer busting before forming one of one or more of the final hand values 17, 18, 19, 20, 21 or blackjack.
Figure 4:
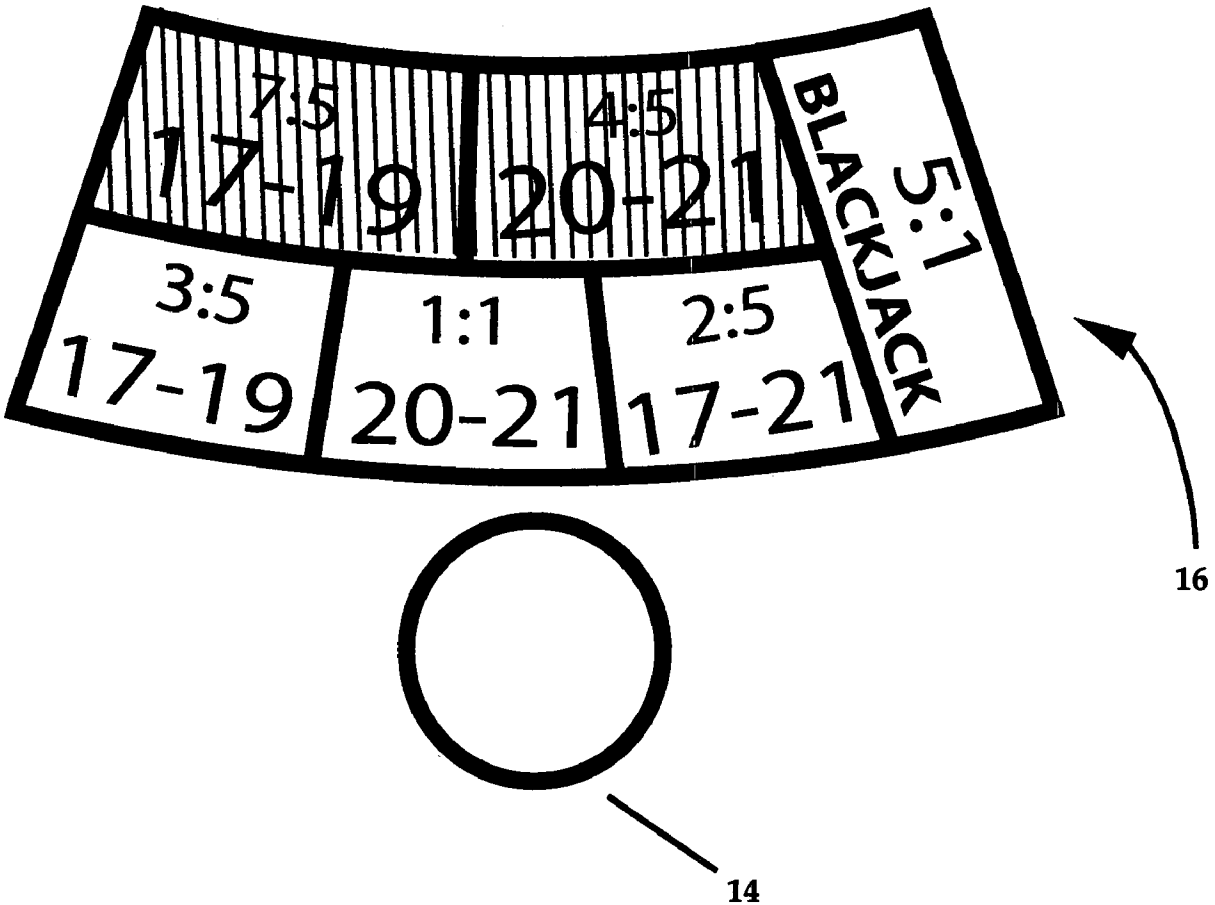
FIG. 4 is an enlarged illustration of the player betting area for the embodiment of FIG. 3.

FIG. 3 represents an embodiment of the invention that provides the player with side bet options based on the probabilities of the dealer forming one of one or more of the final hand values of 17, 18, 19, 20, 21 or blackjack before the dealer busts as well as the reverse side bet options based on the probabilities of the dealer busting before forming one of one or more of the final hand values of 17, 18, 19, 20, 21 or blackjack. FIG. 4 is an enlarged illustration of the additional betting area 16 for the embodiment of the invention illustrated in FIG. 3. This embodiment of the invention offers the player the option of wagering both ways (e.g., either the dealer will form a given final hand value before he busts or the dealer will bust before forming a given final hand value). In this example, the player has the option of placing a single bet that the dealer will form either a 17, 18 or 19 before he busts, a single bet that the dealer will form either a 20 or 21 before he busts, a single bet that the dealer will form either a 17, 18, 19, 20, or 21 before he busts and an individual bet that the dealer will form blackjack before he busts. This example also offers the player the reverse options (represented by the shaded areas to indicate red side bets, as referenced in the inscribed guidelines of play 18) of a single bet that the dealer will bust before he forms a final hand value of 17, 18 or 19 as well as a single bet that the dealer will bust before he forms a final hand value of 20 or 21. A listing of recommended wagering options, their associated true odds, possible payouts and house edges for the embodiment of the invention as illustrated in FIGS. 3 and 4 are enumerated in Tables 1 and 2 set forth below.

TABLE 1

True odds, recommended payouts and associated house edges for the dealer forming the following final hand values before the dealer busts.

| Dealer Forms These Final Hand Values Before Busting | True Odds Payout | Recom-mended Payouts | % 1-Hand House Edge | % Total House Edge |
|---|---|---|---|---|
| 17 | 1.9:1 | 9:5 | 2.1 | 4.9 |
| 18 | 2:1 | 9:5 | 3.2 | 7.6 |
| 19 | 2.1:1 | 9:5 | 4.1 | 9.8 |
| | | 2:1 | 1.5 | 3.6 |
| 20 | 1.6:1 | 6:5 | 6.6 | 14.3 |
| | | 7:5 | 3.0 | 6.5 |
| 21 | 3.9:1 | 3:1 | 6.3 | 17.7 |
| | | 17:5 | 3.4 | 9.6 |
| | | 18:5 | 2.0 | 5.6 |
| | | 19:5 | .5 | 1.4 |
| Blackjack | 5.9:1 | 5:1 | 4.5 | 13.5 |
| | | 28:5 | 1.6 | 4.8 |
| | | 29:5 | .65 | 2.0 |
| 17 or 18 | .99:1 | 4:5 | 5.4 | 9.5 |
| 18 or 19 | 1:1 | 4:5 | 6.4 | 11.5 |
| 19 or 20 | .9:1 | 4:5 | 3.1 | 5.3 |
| 20 or 21 | 1.1:1 | 1:1 | 2.9 | 5.4 |
| 21 or Blackjack | 2.3:1 | 2:1 | 4.1 | 10.2 |
| | | 11:5 | 1.7 | 4.2 |
| 17, 18, or 19 | .67:1 | 3:5 | 3.1 | 4.4 |
| 20, 21 or Blackjack | .94:1 | 4:5 | 4.2 | 7.2 |
| 17, 18, 19 or 20 | .47:1 | 2:5 | 4.2 | 4.8 |
| 17, 18, 19, 20 or 21 | .42:1 | 2:5 | 1.4 | 1.5 |

TABLE 2

True odds, recommended payouts and associated house edges for the dealer busting before forming the following final hand values.

| Dealer Busts Before Forming These Final Hand Values | True Odds Payout | Recom-mended Payouts | % 1-Hand House Edge | % Total House Edge |
|---|---|---|---|---|
| 17 | .52:1 | 2:5 | 3.2 | 7.5 |
| 18 | .49:1 | 2:5 | 2.65 | 6.3 |
| 19 | .47:1 | 2:5 | 2.1 | 5.1 |
| 20 | .64:1 | 3:5 | 1.0 | 2.2 |
| 17 or 18 | 1:1 | 4:5 | 5.9 | 10.4 |
| 18 or 19 | .97:1 | 4:5 | 4.7 | 8.5 |
| 19 or 20 | 1.1:1 | 1:1 | 3.1 | 5.2 |
| 20 or 21 | .9:1 | 4:5 | 2.7 | 5.1 |
| 21 or Blackjack | .43:1 | 2:5 | .75 | 1.9 |
| 17, 18 or 19 | 1.5:1 | 7:5 | 2.3 | 3.3 |
| 20, 21 or Blackjack | 1.1:1 | 4:5 | 4.2 | 7.2 |
| 17, 18, 19 or 20 | 2.1:1 | 2:1 | 3.6 | 4.1 |
| 17, 18, 19, 20 or 21 | 2.4:1 | 11:5 | 5.0 | 7.5 |

Figure 5:
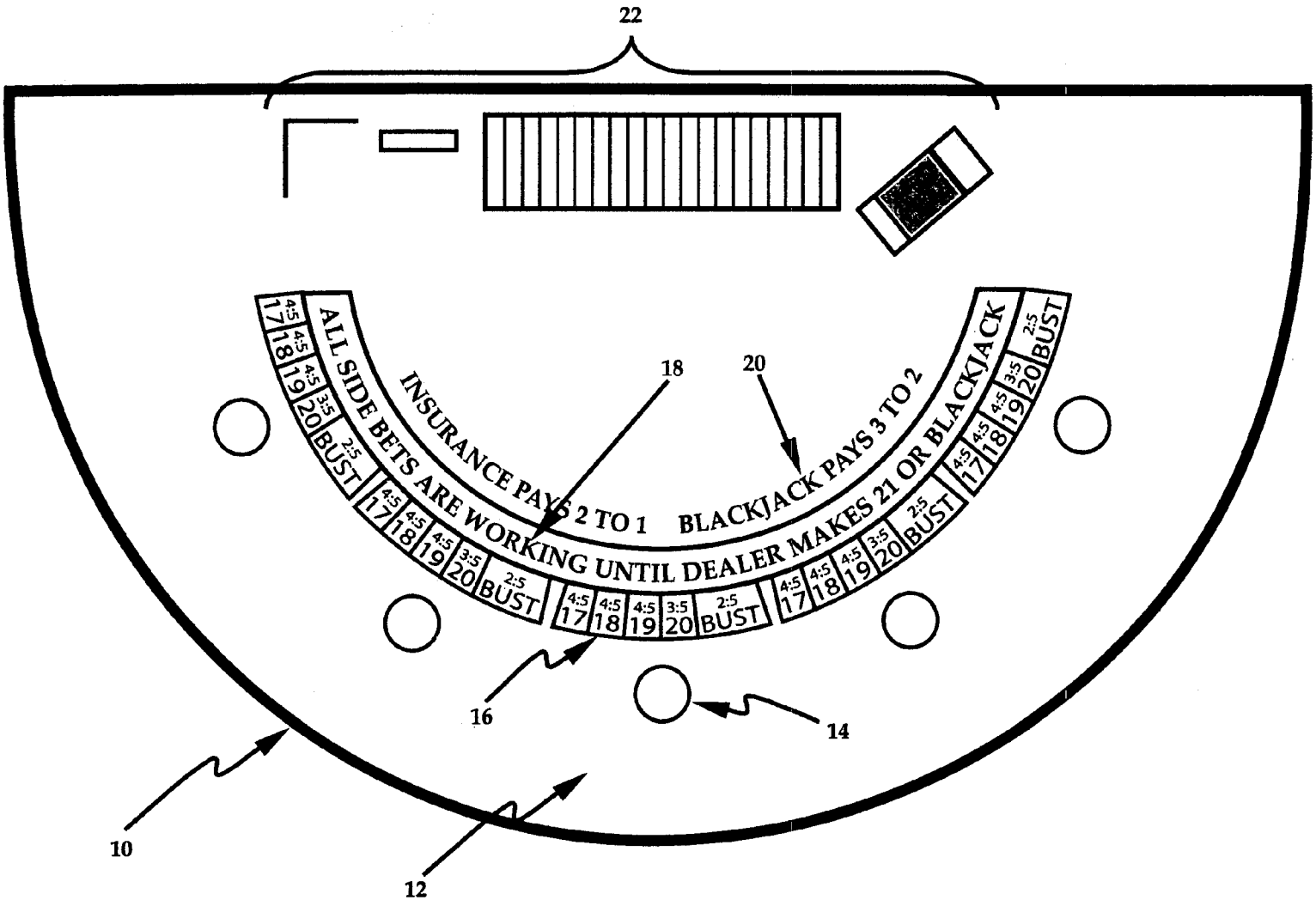
FIG. 5 is an illustration of a playing surface for an embodiment in accordance with the invention that provides wagering options based on the probabilities of the dealer having cards with values totaling final hand values 17, 18, 19, 20 or bust before forming any natural, two-card blackjack or a final hand value of any combination of three or more cards totaling 21.
Figure 6:
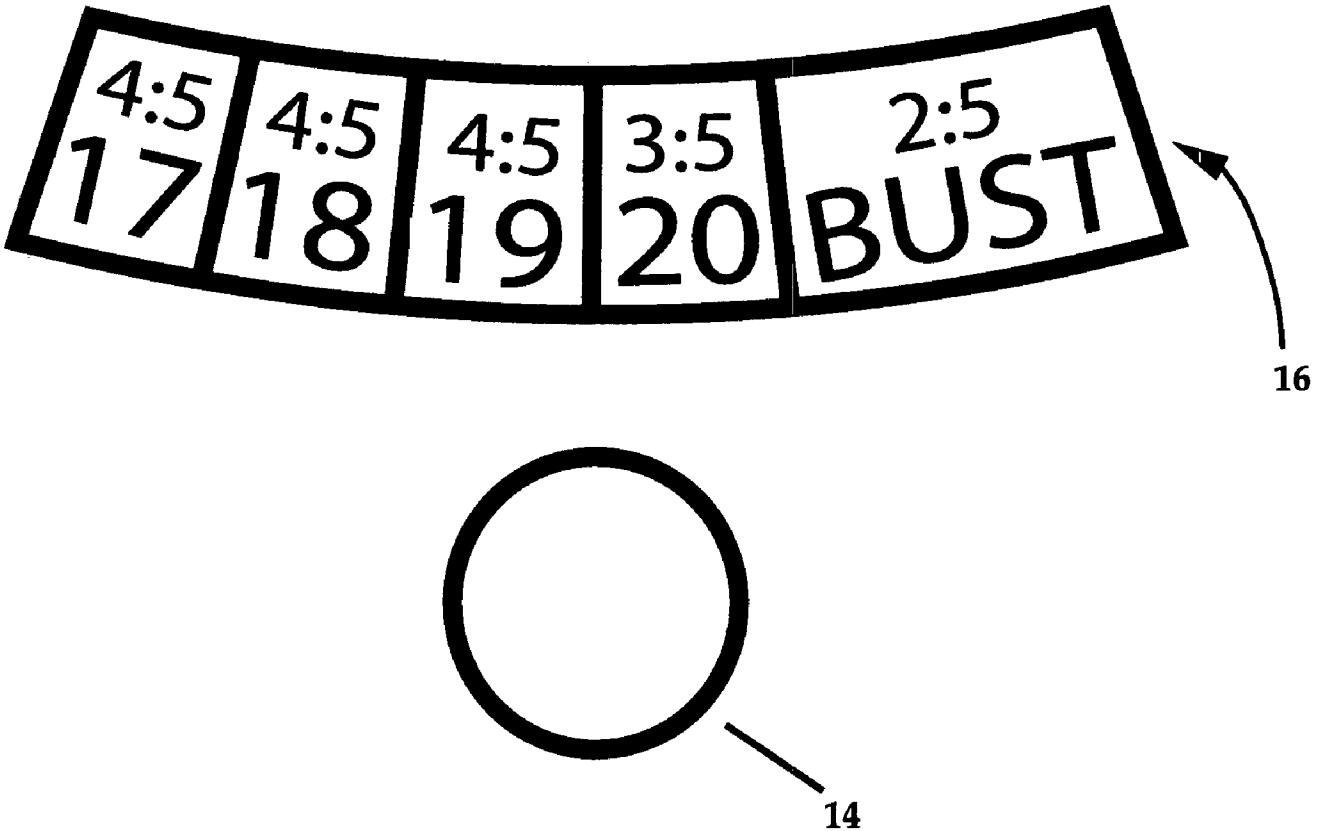
FIG. 6 is an enlarged illustration of the player betting area for the embodiment of FIG. 5.

FIG. 5 represents an embodiment of the invention that provides the player with options for placing individual wagers that the dealer will form a final hand value of 17, 18, 19, 20 or bust before the dealer forms any natural two-card blackjack or any combination of three or more cards totaling 21. FIG. 6 is an enlarged illustration of the additional betting area 16 for the embodiment of the invention illustrated in FIG. 5. A listing of the wagering options, their associated true odds, possible payouts and house edges for the embodiment of the invention as illustrated in FIGS. 5 and 6 are enumerated in Table 3 set forth below.

Figure 7:
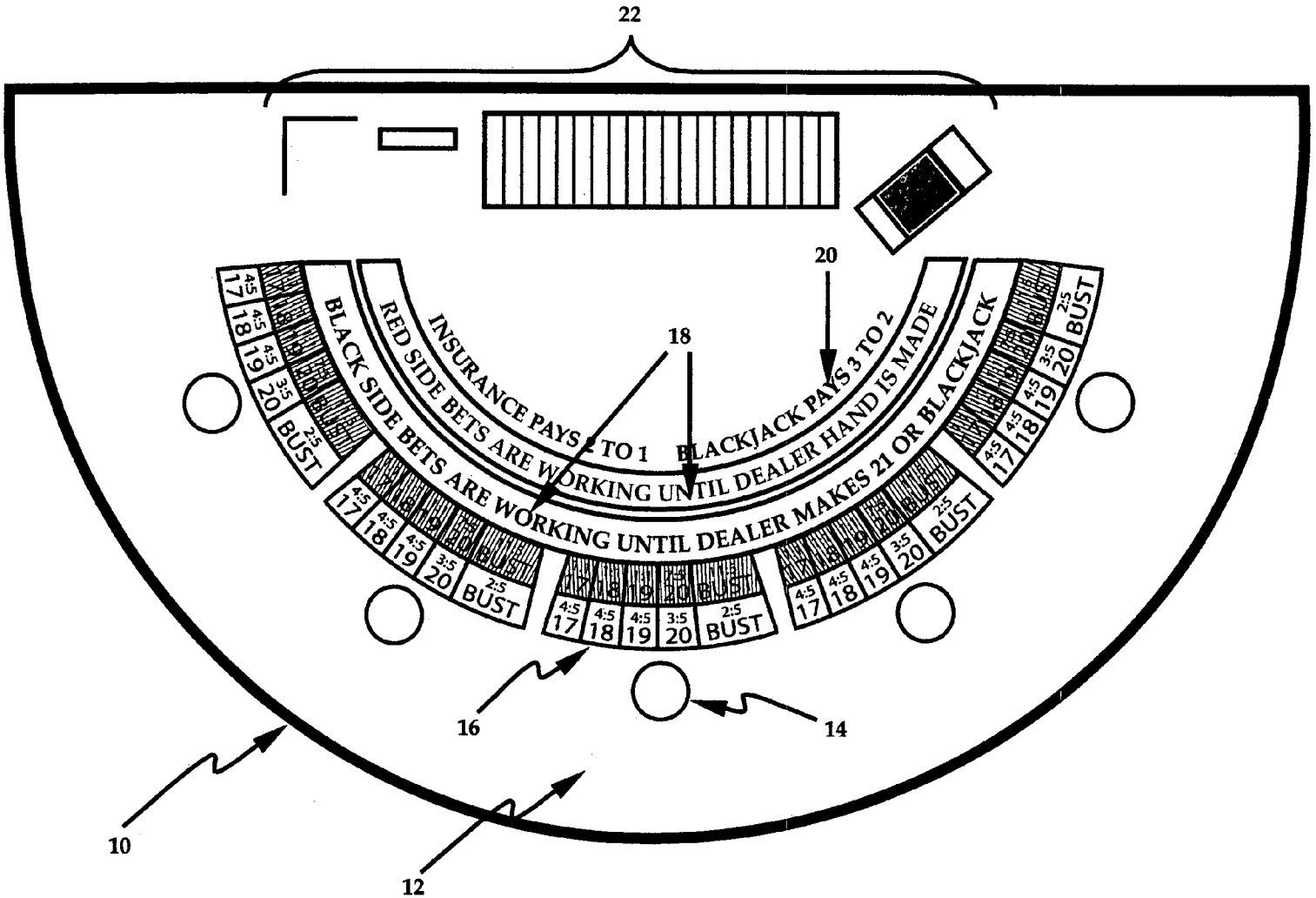
FIG. 7 is an illustration of a playing surface for an embodiment in accordance with the invention that provides wagering options based on the probabilities of the dealer having cards with values totaling final hand values 17, 18, 19, 20 or bust before forming any natural, two-card blackjack or a final hand value of any combination of three or more cards totaling 21, as well as the reverse wagering options based on the probabilities of the dealer forming any natural, two-card blackjack or a final hand value of any combination of three or more cards totaling 21 before forming the final hand values of 17, 18, 19, 20 or bust.
Figure 8:
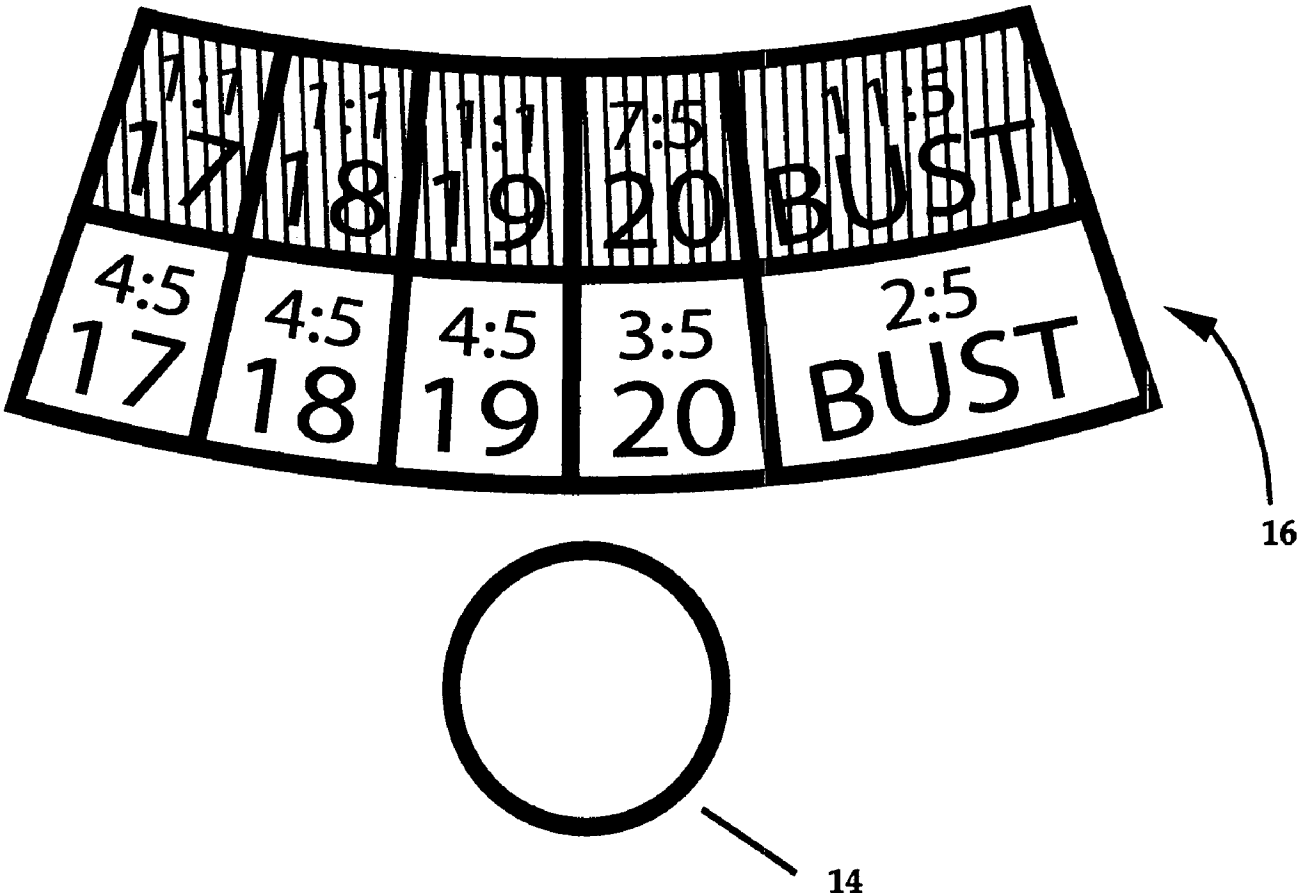
FIG. 8 is an enlarged illustration of the player betting area for the embodiment of FIG. 7.

FIG. 7 represents an embodiment of the invention that provides the player with options for placing individual wagers that the dealer will form a final hand value of 17, 18, 19, 20 or bust before the dealer forms any natural two-card blackjack or any combination of three or more cards totaling 21, as well as the reverse wagers (represented by the shaded areas to indicate red side bets, as referenced in the inscribed guidelines of play 18) that the dealer will form any natural two-card blackjack or any combination of three or more cards totaling 21 before the dealer forms a final hand value of 17, 18, 19, 20 or bust. FIG. 8 is an enlarged illustration of the additional betting area 16 for the embodiment of the invention illustrated in FIG. 7. A listing of the wagering options, their associated true odds, recommended payouts and house edges for the embodiment of the invention as illustrated in FIGS. 7 and 8 are enumerated in TABLES 3 and 4 set forth below.

TABLE 3

True odds, recommended payouts and associated house edges for the dealer forming the following final hand values before forming any natural, two-card blackjack or any combination of three or more cards totaling 21.

| Dealer Forms These Final Hand Values Before BJ or 21 | True Odds Payout | Recom-mended Payouts | % 1-Hand House Edge | % Total House Edge |
|---|---|---|---|---|
| 17 | .83:1 | 3:5 | 3.3 | 12.4 |
| | | 4:5 | .42 | 1.6 |
| 18 | .86:1 | 3:5 | 3.7 | 14.3 |
| | | 4:5 | .9 | 3.5 |
| 19 | .9:1 | 3:5 | 4.0 | 15.7 |
| | | 4:5 | 1.3 | 5.1 |
| 20 | .67:1 | 3:5 | 1.3 | 4.3 |
| Bust | .43:1 | 2:5 | .75 | 1.9 |

TABLE 4

True odds, recommended payouts and associated house edges for the dealer forming any natural two-card blackjack or any combination of three or more cards totaling 21 before forming the following final hand values.

| Dealer Forms BJ or 21 Before These Final Hand Values | True Odds Payout | Recom-mended Payouts | % 1-Hand House Edge | % Total House Edge |
|---|---|---|---|---|
| 17 | 1.2:1 | 1:1 | 2.5 | 9.4 |
| 18 | 1.15:1 | 1:1 | 1.9 | 7.3 |
| 19 | 1.1:1 | 1:1 | 1.3 | 5.1 |
| 20 | 1.5:1 | 7:5 | 1.1 | 3.7 |
| Bust | 2.3:1 | 2:1 | 4.1 | 10.2 |
| | | 11:5 | 1.7 | 4.2 |

Figure 9:
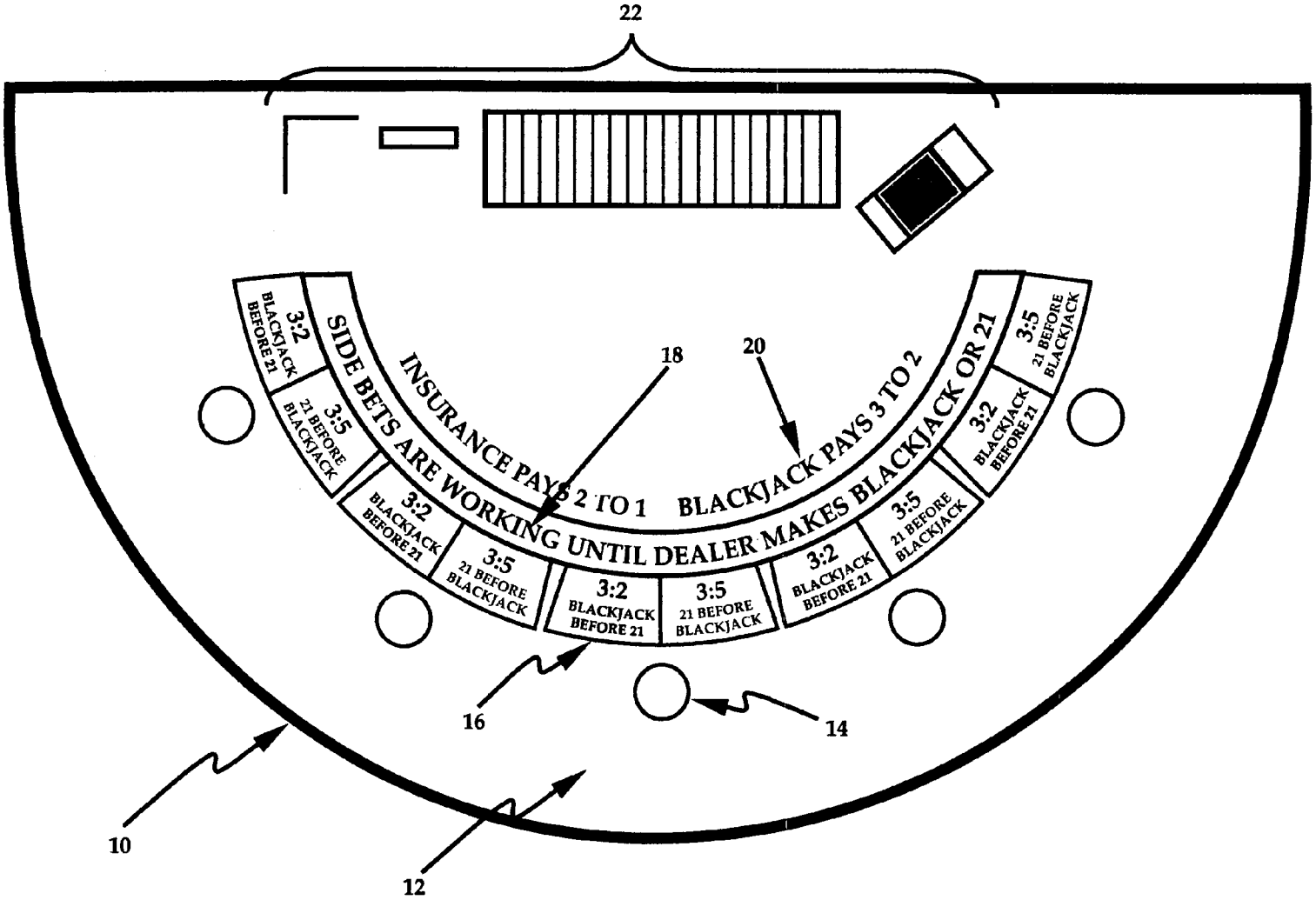
FIG. 9 is an illustration of a playing surface for an embodiment in accordance with the invention that provides wagering options based on the probabilities of the dealer forming any natural two-card blackjack before forming a final hand value of any combination of three or more cards totaling 21, as well as the reverse wagering option based on the probability of the dealer forming a final hand value of any combination of three or more cards totaling 21 before forming any natural two-card blackjack.
Figure 10:
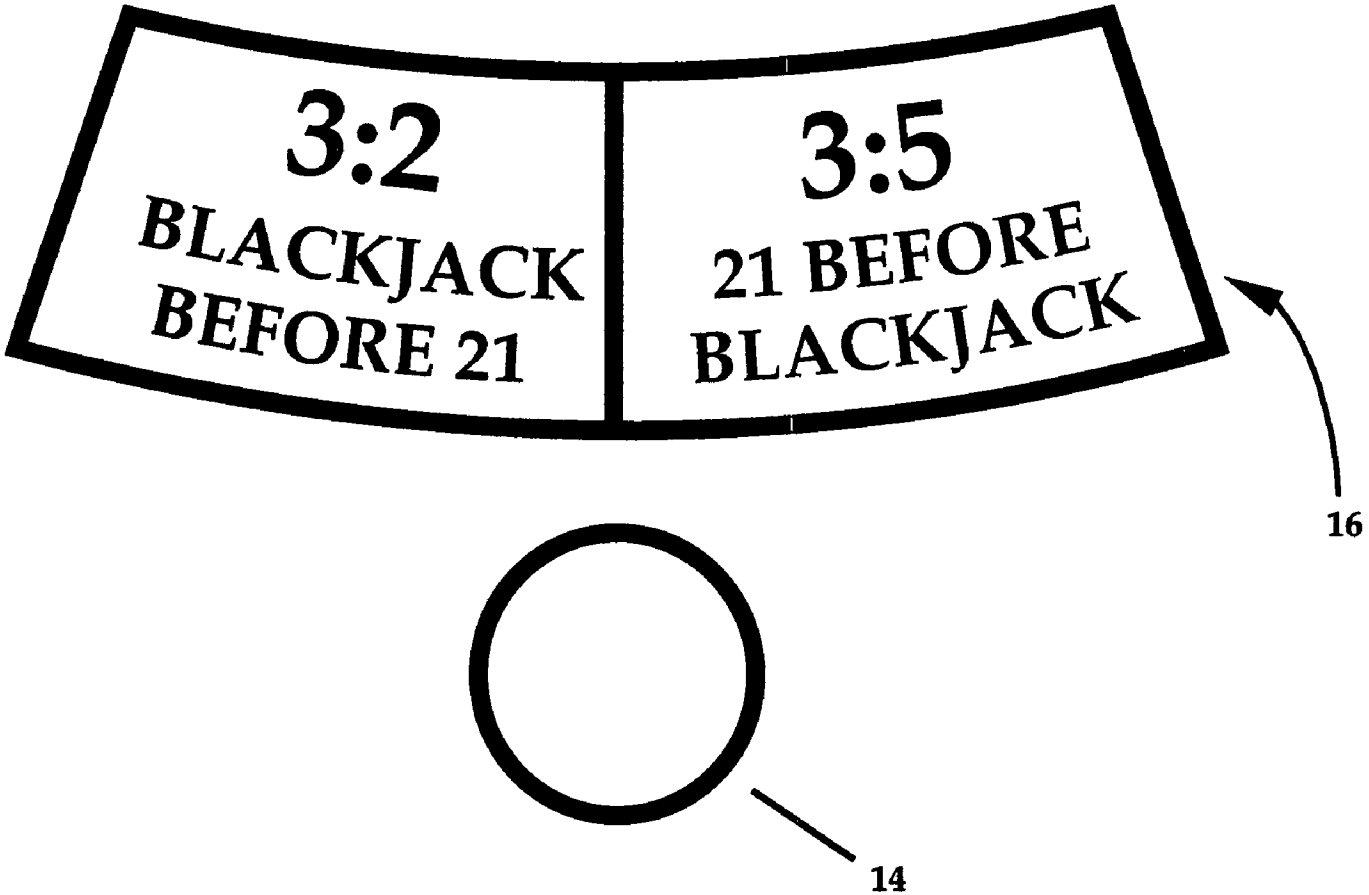
FIG. 10 is an enlarged illustration of the player betting area for the embodiment of FIG. 9.

FIG. 9 represents an embodiment of the invention that provides the player with the option for wagering that the dealer will form any natural two-card blackjack before forming any combination of three or more cards totaling 21 as well as the option for wagering that the dealer will form any combination of three or more cards totaling 21 before forming any natural two-card blackjack. FIG. 10 is an enlarged illustration of the additional betting area 16 for the embodiment of the invention illustrated in FIG. 9. A listing of the wagering options, their associated true odds, recommended payouts and house edges for the embodiment of the invention as illustrated in FIGS. 9 and 10 can be found in Table 5.

TABLE 5

Miscellaneous side bet scenarios

| Dealer Forms These Final Hand Values | True Odds Payout | Recom-mended Payouts | % 1-Hand House Edge | % Total House Edge |
|---|---|---|---|---|
| Blackjack before 21 | 1.53:1 | 7:5 | .64 | 5.3 |
| | | 3:2 | .16 | 1.4 |
| 21 before Blackjack | .65:1 | 3:5 | .38 | 3.2 |
| 17 before 20, 21 or BJ | 2.1:1 | 9:5 | 3.8 | 8.5 |
| | | 2:1 | .9 | 2.1 |
| 20, 21 or BJ before 17 | .48:1 | 2:5 | 2.5 | 5.6 |
| 18 before 20, 21 or BJ | 2.2:1 | 2:1 | 2.1 | 4.8 |
| 20, 21 or BJ before 18 | .46:1 | 2:5 | 1.9 | 4.3 |
| 19 before 20, 21 or BJ | 2.2:1 | 2:1 | 3.3 | 7.6 |
| 20, 21 or BJ before 19 | .45:1 | 2:5 | 1.4 | 3.2 |
| 17, 18 or 19 before 20, 21 or BJ | .72:1 | 3:5 | 4.9 | 6.8 |
| 20, 21 or BJ before 17, 18 or 19 | 1.4:1 | 6:5 | 5.8 | 8.1 |

Overview of the Underlying Mathematical Principles

The underlying mathematics of the invention are based on the probability of one of one or more given events occurring before one of one or more different given events within a greater finite set of events. These mathematical principles apply to the game of Blackjack within the context of the seven possible final dealer hand outcomes of 17, 18, 19, 20, 21, blackjack or bust when the dealer's hand is played to completion. The methodologies used to calculate the true odds payouts, possible payouts and house edges for any side bet scenario of the invention are as follows:

To calculate the true odds payout (T) for any side bet scenario, the sum of the probabilities for the winning events (W) is divided into the sum of the probabilities for the losing events (L).

$$T=L/W$$

As an example, to calculate the true odds payout for the dealer forming a final hand value of either 20 or 21 (excluding a natural, two-card blackjack) before the dealer busts, one divides the sum of the probabilities of the dealer forming either a 20 or 21 on any given hand (18%+7.3%) into the probability of the dealer busting on any given hand (28.2%) to reach the result of approx. 1.1:1.

$$T=28.2/(18+7.3)$$

$$T=28.2/25.3$$

$$T\approx 1.1146245:1$$

By offering slightly less than the true odds payout, the house retains a given edge for any given side bet scenario. To calculate the house edge based on a recommended payout (P) that is less than the true odds payout (T), one must first consider that there are really two house edge calculations to be performed—the house edge based on a single hand of blackjack played (S) and the total house edge (E) based on the average number of hands that would need to be played to ensure a resolution for the betting scenario (H).

To calculate the single-hand house edge (S) for any given side bet, one multiplies the sum of the probabilities for the winning events by the possible or recommended payout (P) for the side bet and subtracts that number from the sum of the probabilities for the losing events.

$$S=L-(W\times P)$$

Using the same side bet scenario of the dealer forming a final hand value of either 20 or 21 before the dealer busts and a recommended payout of 1:1, one calculates the single-hand house edge by multiplying the probability of the dealer forming either a 20 or 21 (25.3%) on any given hand of play by the recommended payout (1:1) and subtracting that number from the probability of the dealer busting (28.2%) on any given hand of play to achieve a single-hand house edge of approximately 2.9%.

$$S=28.2-(1\times 25.3)$$

$$S\approx 2.9\%$$

To determine the total house edge (E) for any given side bet, one calculates how many hands on average must be played for one of the winning or losing events in the side bet to occur (H) and then multiplies that number by the single-hand house edge (S). The average number of hands that must be played for one of the winning or losing events in the side bet to occur (H) is defined as the sum of the probabilities for all seven possible dealer hand outcomes divided by the sum of the probabilities for all winning and losing outcomes.

$$H=100/(W+L)$$

$$E=H\times S$$

Using the same side bet scenario of the dealer forming a final hand value of either 20 or 21 before the dealer busts with a recommended payout of 1:1, one calculates the total house edge for the side bet as follows:

$$H=100/(28.2+25.3)$$

$$H\approx 1.869 \text{ hands}$$

$$E=1.869\times 2.9$$

$$E\approx 5.4\%$$

Alternatively, the following shortcut probability equation can also be used to determine the total house edge (E) for any given betting scenario where the true odds (T) and proposed payout (P) are known.

$$E=(T-P)/(T+1)$$

Using the same example of the dealer forming a final hand value of either 20 or 21 before busting, the total house edge for the betting scenario where the payout is 1:1 and the true odds are 1.1146245:1 would be calculated as follows:

$$E=(1.1146245-1)/(1.1146245+1)$$

$$E=0.1146245/2.1146245$$

$$E\approx 5.4\%$$

The underlying mathematical principles of the invention can be applied to any side bet scenario where the sum of the probabilities for all winning and losing final dealer hand outcomes is less than the total probability for all seven possible dealer hand outcomes.

It should be noted that all figures presented in the following schedules are based on a six-deck shoe with the dealer standing on a soft 17 and where the approximate probabilities for the seven possible dealer hand outcomes are as follows:

| Final Dealer Hand Outcome | Approx. Probability of Occurrence |
|---|---|
| 17 | 14.5% |
| 18 | 13.9% |
| 19 | 13.4% |
| 20 | 18.0% |
| 21 | 7.3% |
| BLACKJACK | 4.75% |
| BUST | 28.2% |

It is also to be understood that the underlying mathematical principles of the invention can be applied to a Blackjack game utilizing any number of standard 52-card decks, regardless of whether the dealer stands or hits on a soft 17.

Additional Working Wager Embodiments and Payout Schedules

In addition to the working wager embodiments and tables set forth above, other working wager embodiments and payout tables might be used to construct additional side bets. Tables 6-10 set forth below are additional working examples of working wagers, with the true odds and possible payouts associated with the wagers. It is to be understood that the Possible Payouts (also termed as "recommended" herein) for the following betting scenarios are provided herein as guidelines only. Those of skill in the art will appreciate that other payouts may be offered as a gaming operator sees fit.

TABLE 6

True odds, recommended payouts and associated house edges for the dealer forming any combination of three or more cards totaling 21 before forming the following final hand values.

| Dealer Forms 21 Before These Final Hand Values | True Odds Payout | Recommended Payouts | % 1-Hand House Edge | % Total House Edge |
|---|---|---|---|---|
| 17 | 2:1 | 9:5 | 1.4 | 6.4 |
| 18 | 1.9:1 | 9:5 | .8 | 3.8 |
| 19 | 1.8:1 | 8:5 | 1.7 | 8.2 |
| | | 9:5 | .25 | 1.2 |
| 20 | 2.5:1 | 11:5 | 1.9 | 7.5 |
| | | 12:5 | .46 | 1.8 |

TABLE 6-continued

True odds, recommended payouts and associated house edges for the dealer forming any combination of three or more cards totaling 21 before forming the following final hand values.

| Dealer Forms 21 Before These Final Hand Values | True Odds Payout | Recom-mended Payouts | % 1-Hand House Edge | % Total House Edge |
|---|---|---|---|---|
| Blackjack | .65:1 | 3:5 | .38 | 3.2 |
| Bust | 3.9:1 | 3:1 | 6.3 | 17.7 |
| | | 17:5 | 3.4 | 9.6 |
| | | 18:5 | 2.0 | 5.6 |
| | | 19:5 | .5 | 1.4 |

TABLE 7

True odds, recommended payouts and associated house edges for the dealer forming the following final hand values before forming any combination of three or more cards totaling 21.

| Dealer Forms These Final Hand Values Before 21 | True Odds Payout | Recom-mended Payouts | % 1-Hand House Edge | % Total House Edge |
|---|---|---|---|---|
| 17 | .5:1 | 2:5 | 1.5 | 6.9 |
| 18 | .52:1 | 2:5 | 1.7 | 8.0 |
| 19 | .55:1 | 2:5 | 1.9 | 9.2 |
| Blackjack | 1.53:1 | 7:5 | .64 | 5.3 |
| | | 3:2 | .16 | 1.4 |

TABLE 8

True odds, recommended payouts and associated house edges for the dealer forming any natural, two-card blackjack before the dealer forms the following final hand values.

| Dealer Gets BJ Before These Final Hand Values | True Odds Payout | Recom-mended Payouts | % 1-Hand House Edge | % Total House Edge |
|---|---|---|---|---|
| 17 | 3.1:1 | 14:5 | 1.2 | 6.3 |
| | | 3:1 | .28 | 1.5 |
| 18 | 2.9:1 | 13:5 | 1.6 | 8.6 |
| | | 14:5 | .63 | 3.4 |
| 19 | 2.8:1 | 12:5 | 2.0 | 11.0 |
| | | 13:5 | 1.0 | 5.5 |
| 20 | 3.8:1 | 17:5 | 1.8 | 7.9 |
| | | 18:5 | .85 | 3.7 |
| 21 | 1.53:1 | 7:5 | .64 | 5.3 |
| | | 3:2 | .16 | 1.4 |
| Bust | 5.9:1 | 5:1 | 4.5 | 13.5 |
| | | 28:5 | 1.6 | 4.8 |
| | | 29:5 | .65 | 2.0 |

TABLE 9

True odds, recommended payouts and associated house edges for the dealer forming the following final hand values before the dealer forms a final hand value of 20.

| Dealer Forms These Final Hand Values Before 20 | True Odds Payout | Recom-mended Payouts | % 1-Hand House Edge | % Total House Edge |
|---|---|---|---|---|
| 17 | 1.2:1 | 1:1 | 3.4 | 10.5 |
| | | 6:5 | .52 | 1.6 |
| 18 | 1.28:1 | 1:1 | 4.0 | 12.5 |
| | | 6:5 | 1.2 | 3.8 |
| 19 | 1.34:1 | 1:1 | 4.6 | 14.7 |
| | | 6:5 | 1.9 | 6.1 |
| 21 | 2.5:1 | 11:5 | 1.9 | 7.5 |
| | | 12:5 | .46 | 1.8 |

TABLE 9-continued

True odds, recommended payouts and associated house edges for the dealer forming the following final hand values before the dealer forms a final hand value of 20.

| Dealer Forms These Final Hand Values Before 20 | True Odds Payout | Recom-mended Payouts | % 1-Hand House Edge | % Total House Edge |
|---|---|---|---|---|
| Blackjack | 3.8:1 | 17:5 | 1.8 | 7.9 |
| | | 18:5 | .85 | 3.7 |
| 21 or Blackjack | 1.5:1 | 7:5 | 1.1 | 3.7 |
| Bust | .64:1 | 3:5 | 1.0 | 2.2 |

TABLE 10

True odds, recommended payouts and associated house edges for the dealer forming a final hand value of 20 before the dealer forms the following final hand values.

| Dealer Forms 20 Before These Final Hand Values | True Odds Payout | Recom-mended Payouts | % 1-Hand House Edge | % Total House Edge |
|---|---|---|---|---|
| 17 | .8:1 | 3:5 | 3.7 | 11.4 |
| 18 | .78:1 | 3:5 | 3.1 | 9.7 |
| 19 | .74:1 | 3:5 | 2.6 | 8.3 |
| 21 or Blackjack | .67:1 | 3:5 | 1.3 | 4.3 |
| Bust | 1.6:1 | 6:5 | 6.6 | 14.3 |
| | | 7:5 | 3.0 | 6.5 |

It is to be understood that the embodiments shown and described herein are merely illustrative of the principles of this invention and that various modifications may be implemented by those skilled in the art without departing from the scope and spirit of the invention.

What is claimed is:

1. A method of playing the card game Blackjack, the Blackjack game of the type including a dealer and at least one player, comprising:

a) placing wagers prior to a first hand of play that at least one of one or more predetermined final dealer hand values will occur before one of one or more different designated final dealer hand values, wherein the sum of the probabilities for the predetermined winning and losing final dealer hand values for any given hand of play is less than the total probability for all possible final dealer hand values during any given hand of play;

b) dealing cards to the dealer and the player for the first hand of play; and c) determining if the wager is satisfied, wherein:

i) the placed wager is won by the player only when a predetermined winning final dealer hand value occurs during the first hand of play;

ii) the placed wager is lost by the player only when a predetermined losing final dealer hand value occurs during the first hand of play; and iii) the placed wager is neither won or lost if neither a predetermined winning or losing final dealer hand value occurs during the first hand of play.

2. The method of playing the card game according to claim 1, further comprising:

a) allowing the player to remove or maintain the placed wager prior to a second hand of play; and b) dealing cards and determining if the placed wager is satisfied in accordance with steps b) and c) if the placed wager has been maintained.

3. The method of playing the card game according to claim 1, further comprising:

a) allowing the player to place additional wagers prior to a second hand of play in accordance with step a); and b) dealing cards and determining if the placed wager and placed additional wager is satisfied in accordance with steps b) and c).

4. The method of playing the card game according to claim 2, further comprising:

a) allowing the player to place additional wagers prior to a second hand of play in accordance with step a); and b) dealing cards and determining if the placed wager and placed additional wager is satisfied in accordance with steps b) and c) if the placed wager has been maintained.

5. The method of playing the card game according to claim 1, wherein the total probability for all possible final dealer hand values includes the sum of the probabilities for the seven final dealer hand values of 17, 18, 19, 20, any three or more cards totaling 21, any two-cards totaling 21 and any combination of cards that exceeds a value of 21.

6. The method of playing the card game according to claim 1, wherein the placed wager includes a wager for or against the occurrence of a first set of final dealer hand values, the first set defined as 17, 18, 19, 20, 21 and an initial two card value of 21, either individually or in a combination of five or less of the first set before the occurrence of a final dealer hand value that exceeds 21.

7. The method of playing the card game according to claim 1, wherein the placed wager includes a wager for or against the occurrence of a second set of final dealer hand values, the second set defined as 17, 18, 19, 20, and three or more cards totaling more than 21, either individually or in any combination of four or less of the second set before the occurrence of either a final dealer hand value of any natural, two-card blackjack or any combination of three or more cards totaling 21.

8. The method of playing a card game according to claim 1, wherein the placed wager includes a wager for or against the occurrence of a third set of final dealer hand values, the third set defined as 17, 18, 19, 20, an initial two card value of 21 and three or more cards totaling more than 21, either individually or in any combination of five or less of the third set before the occurrence of a final dealer hand value of three or more cards totaling 21.

9. The method of playing a card game according to claim 1, wherein the placed wager includes a wager for or against the occurrence of a final dealer hand value of the first two cards totaling 21 before the occurrence of a fourth set final dealer hand values, the fourth set defined as 17, 18, 19, 20, 21 and three or more cards totaling more than 21, either individually or in any combination of five or less of the fourth set of final dealer hand values.

10. The method of playing a card game according to claim 1, wherein the placed wager includes a wager for or against the occurrence of a fifth set of final dealer hand values, the fifth set defined as 17, 18, 19, 21, an initial two card value of 21 and three or more cards totaling more than 21, either individually or in any combination of five or less of the fifth set of final dealer hand values before the occurrence of a final dealer hand value of 20.

11. The method of playing a card game according to claim 1, wherein the placed wager includes a wager for or against the occurrence of a final dealer hand value of 21 before the occurrence of a final dealer hand value of an initial two card value of 21.

12. The method of playing a card game according to claim 1, wherein the placed wager includes a wager for or against the occurrence of a final dealer hand value of 17 before the occurrence of a final dealer hand value of 20, 21 or an initial two card value of 21.

13. The method of playing a card game according to claim 1, wherein the placed wager includes a wager for or against the occurrence of a final dealer hand value of 18 before the occurrence of a final dealer hand value of 20, 21 or an initial two card value of 21.

14. The method of playing a card game according to claim 1, wherein the placed wager includes a wager for or against the occurrence of a final dealer hand value of 19 before the occurrence of a final dealer hand value of 20, 21 or an initial two card value of 21.

15. The method of playing a card game according to claim 1, wherein the placed wager includes a wager for or against the occurrence of a final dealer hand value of 17, 18 or 19 before the occurrence of a final dealer hand value of 20, 21 or an initial two card value of 21.

16. The method of playing a card game according to claim 1, further comprising paying the player after a successful wager.

17. The method of playing a card game according to claim 1, further comprising allowing the player to make a primary wager for Blackjack game and determining if the wager is successful by comparing the cards dealt to the player against the cards dealt to the dealer.

18. The method of playing a card game according to claim 1, wherein the placed wager is positioned in a predetermined, marked area on a casino blackjack table with individual player positions.

19. The method of playing a card game according to claim 1, further comprising using a computer to determine the cards to be dealt to the dealer and player using a random number generator.

* * * * *